United States Patent [19]

Takita et al.

[11] Patent Number: 5,035,175

[45] Date of Patent: Jul. 30, 1991

[54] MIMEOGRAPHIC PRINTING APPARATUS AND CLAMPING DEVICE THEREFOR

[75] Inventors: Nagon Takita; Yoshihiro Noguchi, both of Ushiku, Japan

[73] Assignee: Riso Kagaku Corporation, Tokyo, Japan

[21] Appl. No.: 541,121

[22] Filed: Jun. 20, 1990

[30] Foreign Application Priority Data

Jun. 22, 1989 [JP] Japan ..... 1-158408

[51] Int. Cl.[5] ..... B41L 13/06

[52] U.S. Cl. ..... 101/116; 101/118

[58] Field of Search ..... 101/116–120

[56] References Cited

U.S. PATENT DOCUMENTS 4,966,073 10/1990 Hasegawa et al. ..... 101/120

FOREIGN PATENT DOCUMENTS 59-96984 6/1984 Japan ..... 101/116

61-104854 5/1986 Japan ..... 101/116

*Primary Examiner*—Clifford D. Crowder

*Attorney, Agent, or Firm*—Kanesaka and Takeuchi

[57] ABSTRACT

A mimeographic printing apparatus having a printing drum wound with a stencil and a clamping plate for fastening one end of the stencil on the drum. An elastic holding device is provided over a clamping position with a gap from the drum enough to receive one end of the supplied stencil. The holding device is, at the clamping state, pressed by the clamping plate to fasten one end of the stencil on the printing drum. At the non-clamping position, the holding device returns to the original position and here restrains the external curling of the stencil. The result is that the stencil thereafter reliably introduced to the removing device, thereby realizing a normal stencil-removing operation.

4 Claims, 6 Drawing Sheets

MIMEOGRAPHIC PRINTING APPARATUS AND CLAMPING DEVICE THEREFOR

BACKGROUND OF THE INVENTION

1. Field of the Invention

This invention relates to a mimeographic printing apparatus of the type in which a stencil can be automatically removed from a printing drum.

2. Description of the Related Art

Heretofore, a rotary mimeographic printing apparatuses having a rotary printing drum is known in which one end of a stencil is secured to the printing drum and is then wound therearound. This prior art is exemplified by Japanese Patent Laid-Open Publication No. 96984/1984. The apparatus of the Japanese Publication No. 96984/1984 includes a clamping piece pivotally supported on an outer surface of the printing drum and a magnetic plate supported on the outer surface of the printing drum for attracting the clamping piece to the outer surface to grip one end of the stencil.

This prior apparatus is suitable to mount a thin stencil like a stencil on the printing drum satisfactorily. After completion of printing process, however, the gripped end of the stencil would sometimes remain adhered to the surface of the magnetic plate owning to the static electricity even after the clamping piece is released from the magnetic plate.

To solve this problem, a printing apparatus equipped with a means for peeling the stencil from the printing drum as the clamping piece is released, has been proposed by Japanese Patent Laid-Open Publication No. 104854/1986.

The prior apparatus of the Japanese Publication No. 104854/1986 includes a pivotable clamping piece selectively attractable to the magnetic plate disposed on the circumference of the printing drum, and an elastic thin piece having one end fixed to the clamping piece and the other end extending over the magnetic plate and fixed to the circumference of the printing drum. When the clamping piece is released from the magnetic plate, the elastic thin piece floats over the magnetic plate, thereby peeling the stencil from the printing drum. With this arrangement, subsequent stencil-removing can be smoothly performed since the stencil already assumes a peeled posture as the clamping piece is released.

Generally, in the foregoing apparatuses, a stencil in the form of a roll is used. In this type of stencil, its end portion apts to be externally curled due to the initial curl in the rolling direction or to the change of conditions during the manufacturing process. If the curling degree is excessive, the following inconvenience would arise; when the clamping piece is released and the stencil is peeled from the magnetic plate, the distal end of the stencil becomes externally curled again. If the curling degree is small, there would be no particular problem in performing the subsequent removing of the stencil. However, if the curling degree is promoted by the factors as temperature, humidity, etc., the removing means could not certainly capture the end of the stencil so that the stencil cannot be removed reliably.

SUMMARY OF THE INVENTION

It is therefore an object of this invention to provide a mimeographic printing apparatus, which is capable of preventing the external curling of the stencil after a clamping piece is released to reliably introduce the stencil into the subsequent stencil-removing means, thereby realizing a normal stencil-removing process.

The mimeographic printing apparatus of this invention includes a printing drum provided with a pivotable clamping piece and a stencil-removing means. A stencil is wound around the printing drum with one end being fastened on the drum by the clamping piece. Upon completion of the printing process, the stencil is released from the clamping piece and is then removed by the stencil-removing means for discharge.

Further, an elastic holding means is disposed over the clamping position of the clamping piece. The stencil is introduced into the space between the holding member and the printing drum to be fastened on the drum. As a result, on releasing the clamping piece, the holding means is returned to its original position, holding down the free end of the stencil against curling.

The above and other advantages, features and additional objects of this invention will be manifest to those versed in the art upon making reference to the following detailed description and the accompanying drawings in which two preferred structural embodiments incorporating the principles of this invention are shown by way of illustrative example.

DETAILED DESCRIPTION

A mimeographic printing apparatus according to a first embodiment of this invention will now be described with reference to FIGS. 1 through 6.

Figure 1:
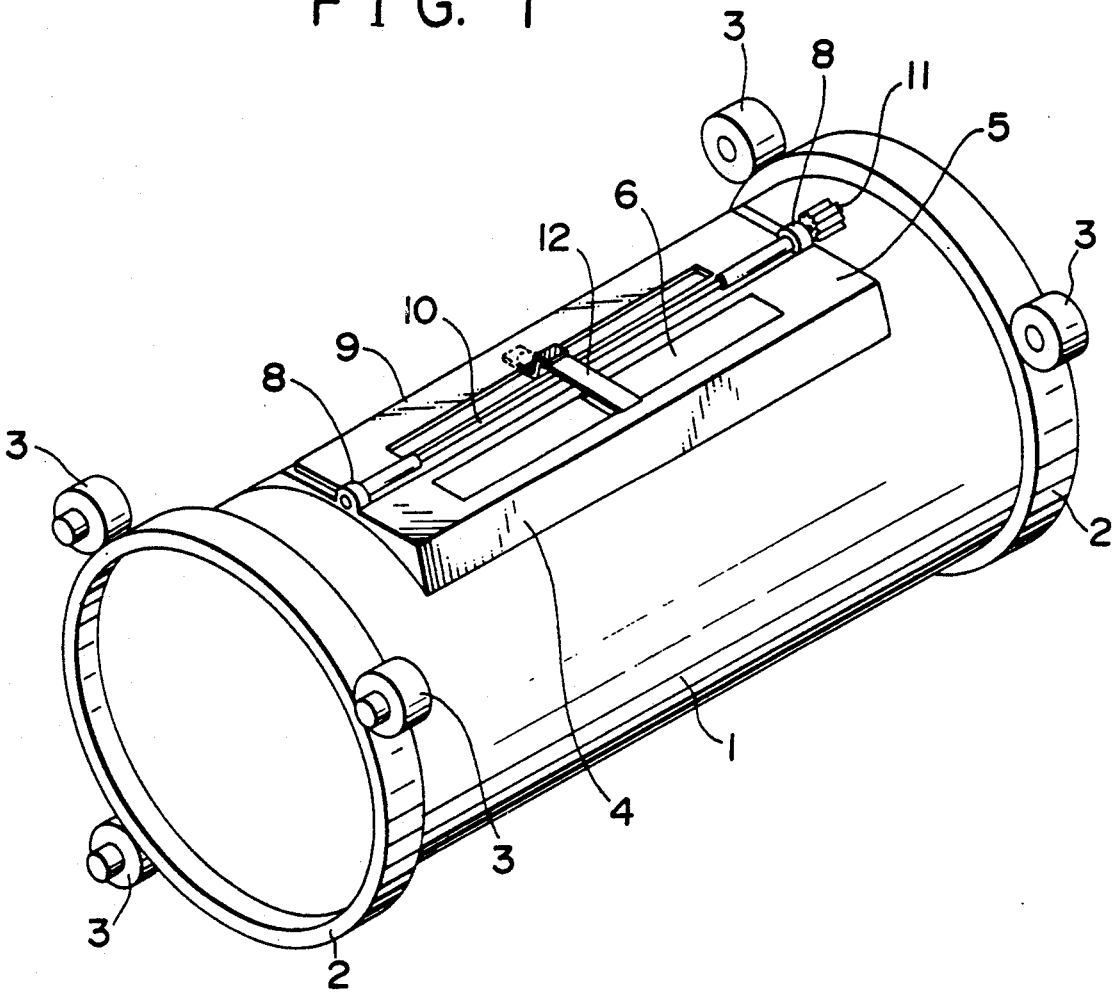
FIG. 1 is a perspective view showing a mimeographic printing apparatus according to a first embodiment of this invention.

In FIG. 1, reference numeral 1 designates a cylindrical printing drum supported by a plurality of supporting rollers 3 so as to be rotatable on a frame (not shown) about its central axis line. These supporting rollers 3 are rotatably mounted on a pair of ring-shaped circumferential guide portions 2 at the opposite ends of the printing drum 1.

On an outer surface of the printing drum 1, a stencil-mounting base 4 is secured. The stencil-mounting base 4 has a flat upper surface 5 parallel to a tangential plane of the printing drum 1. At the opposite sides of the upper surface 5 of the stencil-mounting base 4, magnetic plates 6, 7 each in the form of a strip are buried so as to extend parallel to the axis of the drum 1. Each of the magnetic plates 6, 7 includes a permanent magnetic having a suitable flexibility like a multipole rubber magnet. The external (upper) surface of the individual magnetic plates 6, 7 flushes with the upper surface 5 of the stencil-mounting base 4.

Between the two magnetic plates 6, 7 and at the opposite ends of the stencil-mounting base 4, a pair of bearing brackets 8, 8 is mounted to support a pivot shaft 10. The pivot shaft 10 is formed on a strip-like clamping piece 9 integrally therewith.

Figure 2:
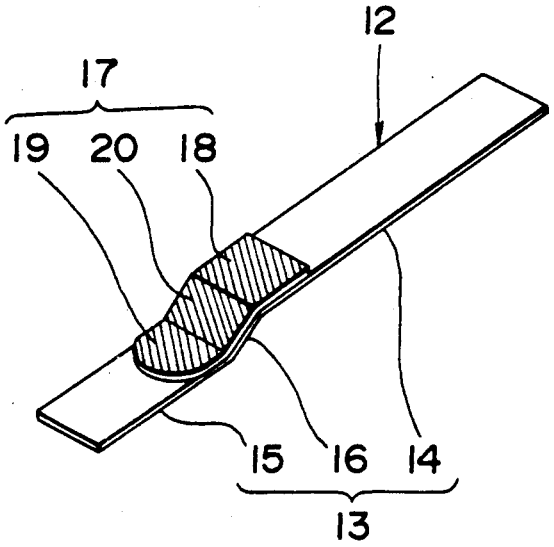
FIG. 2 is a detailed perspective view showing a holding means of the apparatus of FIG. 1.
Figure 3:
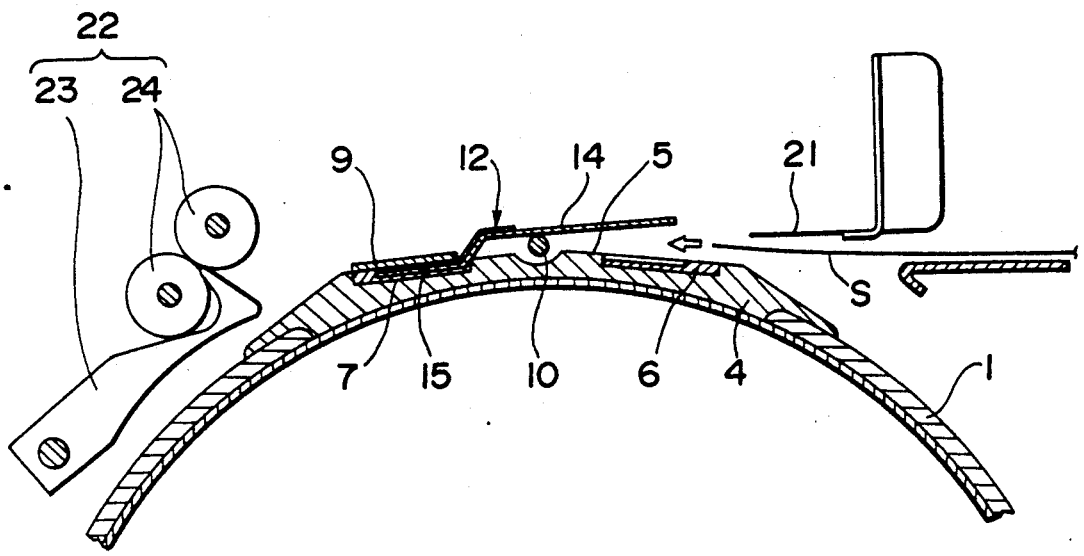
FIGS. 3 through 6 are cross-sectional views showing the operation of the apparatus of FIG. 1.
Figure 4:
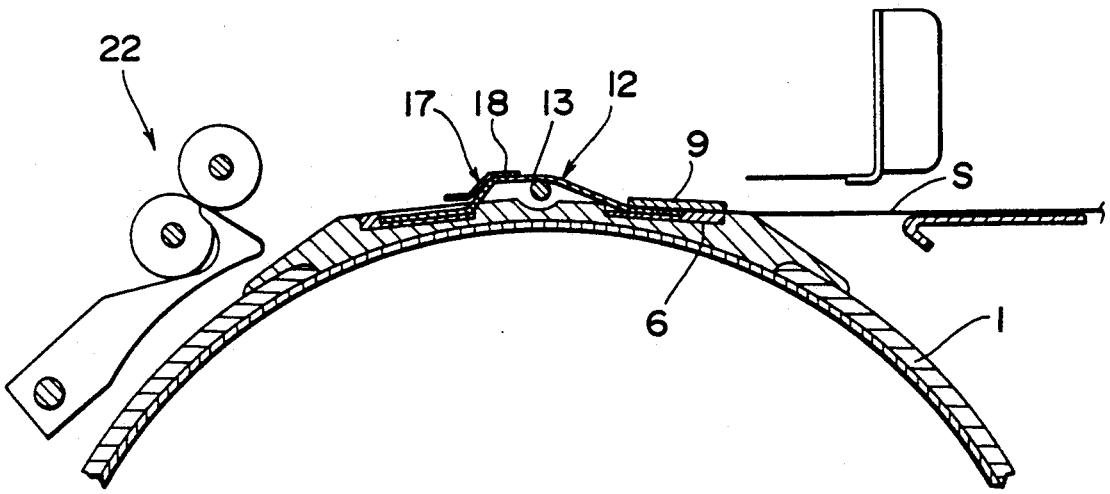
Figure 5:
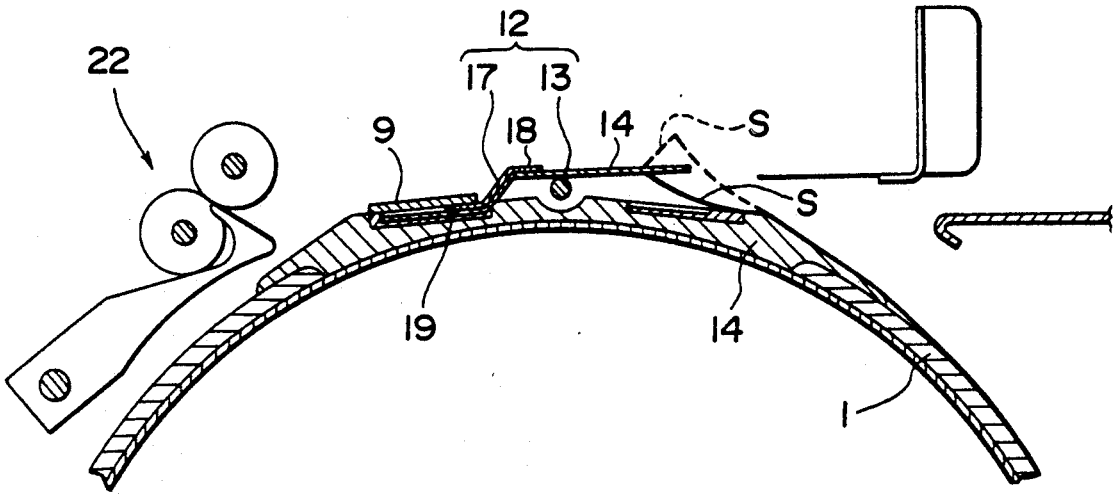

The clamping piece 9 is supported by the pivot shaft 10 on the printing drum 1 so as to be pivotable between a first (clamping) state and a second (nonclamping) state. In the clamping state the clamping piece 9 is attracted to the magnetic plate 6 as shown in FIG. 4, while at the non-clamping state the clamping piece 9 is attracted to the other magnetic plate 7 as it is released from the magnetic plate 6 and is pivotally moved through 180° as shown in FIGS. 1 through 3.

At one end of the pivot shaft 10, a driven pinion 11 is provided. A non-illustrated driving gear selectively meshes the driven pinion 11, thereby pivotally moving the clamping piece 9 between the clamping state and the non-clamping state. If a more detailed explanation on this clamping piece driving mechanism is needed, refer to the Japanese Patent Application No. 207217/1982.

At a substantially central portion of the stencil-mounting base 4, there is disposed a means for holding the stencil S. As shown in FIG. 2, the holding means 12 includes an elastic sheet 13 and a rigid return plate superimposed thereon. The elastic sheet 13 has three step portions, namely, a holding portion 14, a base portion 15, and a coupling portion 16. The return plate 17 has a similar configuration to be fitted to the elastic sheet 13.

Only an upper strip portion 18 of the return plate 17 is fixed to the holding portion 14 of the elastic sheet 13. A lower strip portion 19 and the intermediate piece portion 20 of the return plate 17 as well as the base portion 15 and the coupling portion 16 of the elastic sheet 13 are left non-fixed. As shown in FIGS. 1 and 3, the holding member 12 is secured to the stencil-mounting base 4 in a manner such that its longitudinal side perpendicularly crosses the pivot shaft 10.

Namely, the base portion 15 of the holding member 12 seems to be fixed within a recess formed on the magnetic plate 7, while the holding portion 14 extends above the pivot shaft 10 to the magnetic plate 6 with a predetermined space therefrom above the horizon. Since the distal end of the holding member 12 is intended to hold the end of a stencil S downwardly, it had better be low. As shown in FIG. 3, however, the stencil S is supplied through a guide plate 21 to the printing drum 1 set at a predetermined position. Therefore, the distal end of the holding portion 14 is set at a level equal to or slightly higher than that of the guide plate 21.

As the base portion 15 of the holding member is fixed within the identically-shaped recess of the magnetic plate 7, the attracting surface of the magnetic plate 7 is designed to be flat. The magnetic plate 6 has a rectangular recess to which the holding portion 14 is fitted. As a result, the upper surface of the holding portion 14 flushes with that of the magnetic plate 6 when the holding portion 14 is held between the magnetic plate 6 and the clamping piece 9 in the clamping state.

At the side opposite to the stencil supplying side of the printing drum 1, a pair of stencil-removing means 22 are provided (only one set is illustrated in the drawing). This pair of stencil-removing means 22 is placed at the opposite ends of the printing drum 1 with the holding means 12 therebetween with respect to the central axis line. Each stencil-removing means 22 has a removing claw 23 and a removing roller 24. The removing claw 23 introduces the end of the stencil, which has been freed from the clamping piece 9, to the removing roller 24. Thereafter, the stencil S will be removed from the printing drum 1 as the drum 1 is rotated.

The operation will now be described with reference to FIGS. 3 through 6. The stencil used in this embodiment is slightly curled as it has been initially wound in rolled state.

Firstly, as shown in FIG. 3, the printing drum 1 is set in the stencil-mounting position where the stencil-mounting base 4 is at the top of the apparatus. At this time, the clamping piece 9 is attracted to the magnetic plate 7 in the non-clamping state. Therefore, the holding portion 14 of the holding member 12 is in a free state over the magnetic plate 6 to which the stencil S will be fastened.

Then, a stencil S produced by a non-illustrated means is supplied over the printing drum 1 through the guide plate 21. Since the distal end of the holding portion 14 is set at a level higher than that of the guide plate 21, the end of the supplied stencil S can be reliably introduced between the holding member 12 and the upper surface 5 of the stencil-mounting base 4.

Thereafter, the pivot shaft 10 is turned in the clockwise direction by a non-illustrated driver means. Consequently, as shown in FIG. 4, the clamping piece 9 will be attracted to the magnetic plate 6 with the holding member 12 and the stencil S fastened therebetween in a clamping state. Although the upper strip portion 18 of the holding member 12 is secured to the elastic sheet 13, the remaining portions are left non-secured. Accordingly, the return plate 17 does not obstruct the desired deformation of the elastic sheet 13 by being pressed down by the clamping piece 9.

Subsequently, a non-illustrated cutter means cuts the continuous sheet-type stencil S for a suitable length. The printing drum 1 rotates counter-clockwise to wind the stencil S therearound. Then, printing papers will be supplied between the printing drum 1 and a non-illustrated roller located below the drum 1, thus starting the printing process.

Upon completion of the printing process, the printing drum is set again at the position where the stencil-mounting base 4 is at the top of the apparatus. When a stencil-removing command or a next processing/printing command from a non-illustrated operation unit is supplied, the clamping piece 9 is reset at the non-clamping position. The clamping piece 9 of this state presses the lower piece portion 19 of the return plate 17 downwardly so that the holding portion 14 of the elastic sheet 13 integral with the upper strip portion 18 is immediately returned to the original position.

The released free end of the stencil S will then be externally curled, but it collides from the lower side, with the holding member 12 having been returned to the original position as released in the same manner. As a result, the end of the stencil S cannot be externally curled any more.

Figure 6:
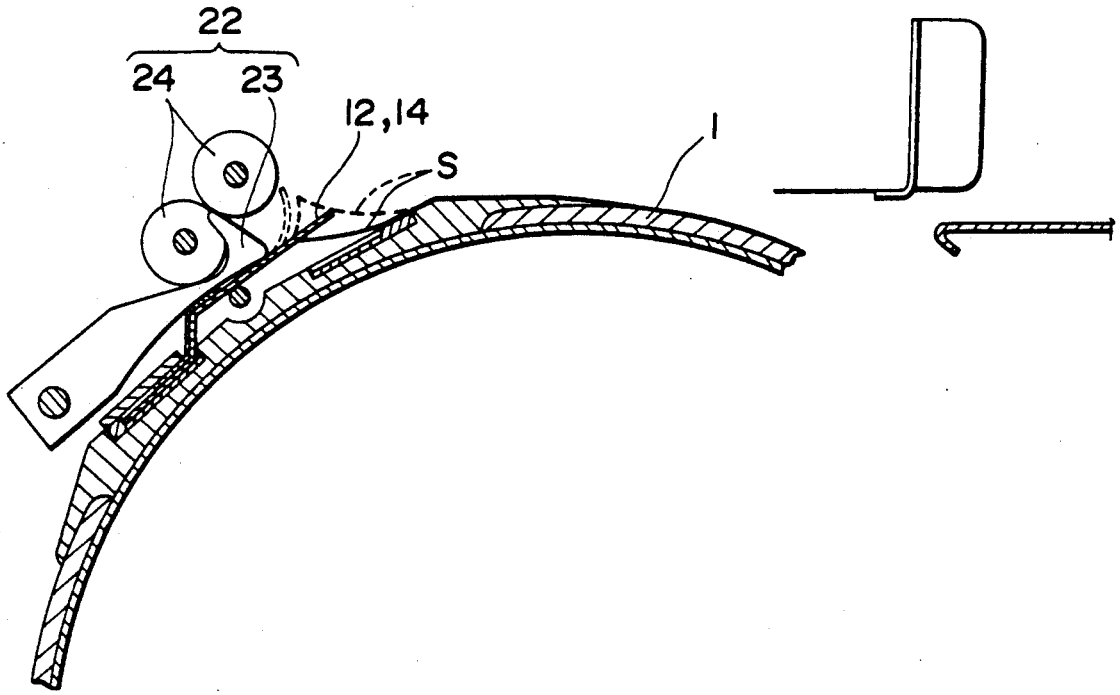
Figure 7:
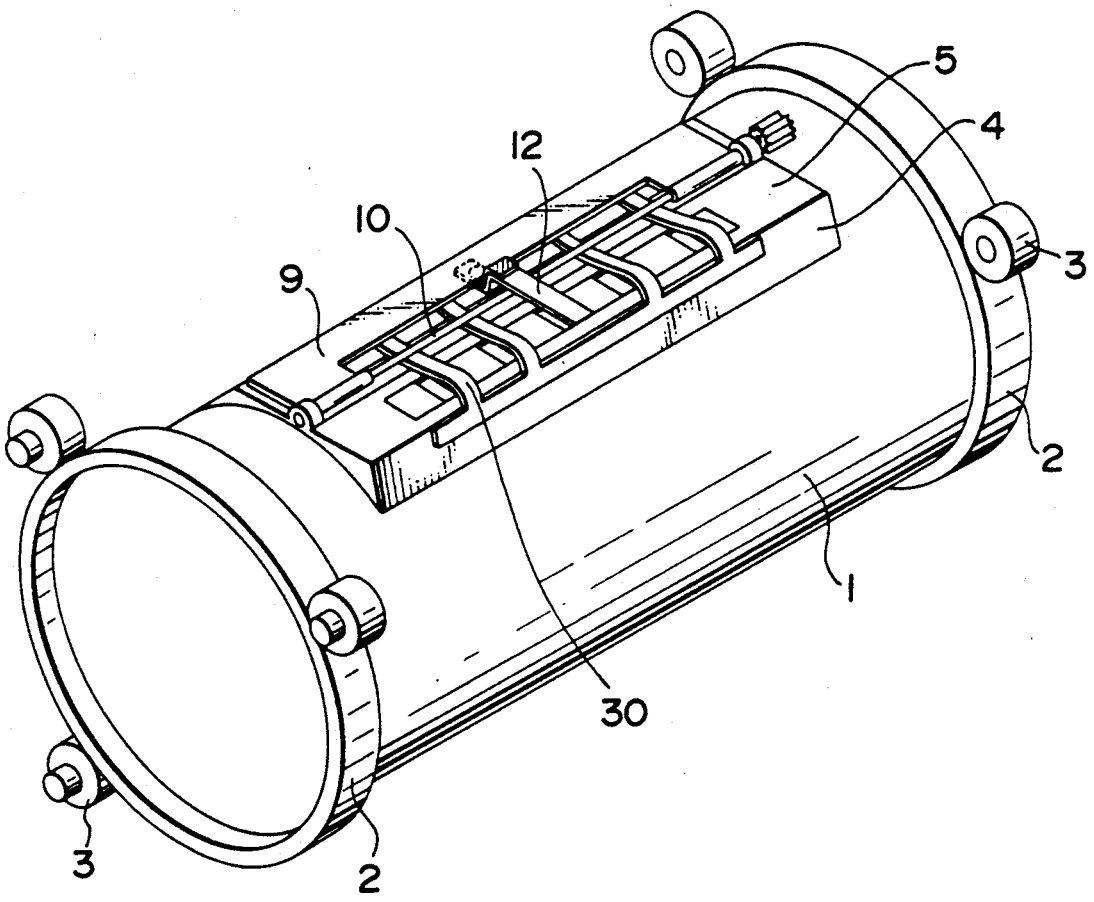
FIG. 7 is a view similar to FIG. 1, showing a modified mimeographic printing apparatus according to a second embodiment.

Thereafter, as shown in FIG. 6, the printing drum 1 rotates in the counterclockwise direction. Since it is held at the desirable level over the printing drum 1 by the holding member 12, the stencil S can be guided by the removing claw 23 disposed near the printing drum 1 and can be reliably introduced to the removing roller 24. With the mutual rotating operation of the printing drum 1 and the removing roller 24, the stencil S is removed from the drum 1 and is then discharged. At this time, with the center portion being held by the holding member 12, the opposite ends of the stencil are gradually drawn to the removing rollers 24. Therefore, although the holding portion 14 of the holding member 12 will be upwardly warped as removing the stencil S, it recovers the original form upon removal of the end of the stencil S therefrom.

As described above, according to this embodiment, the external curling of the stencil after released from the clamping state can be prevented, thereby reliably feeding the stencil to the removing means to perform a normal stencil-removing process.

A second embodiment of this invention will now be described with reference to FIGS. 7 through 11.

This embodiment features that an elastic piece 30 functions to peel the stencil S adhered to the stencil-mounting base 4. The elastic thin piece 30 is proposed by Japanese Patent Application No. 227323/1984 and published as Japanese Patent Laid-Open Publication No. 104854/1986. Therefore, the description on this elastic thin piece 30 is simplified here, omitting the description of the detailed or unessential structure.

A cylindrical recess 4*a* is formed on the upper surface 5 of the stencil-mounting base 4 facing the pivot shaft 10. The stencil-mounting base 4 has an inclined surface 4*b* at the end remote from the pivot shaft 10. On the inclined surface 4*b*, one ends of several elastic thin pieces 30 united together are secured by a suitable means such as an adhesive agent. The other ends of the elastic thin pieces 30 extend to the other magnetic plate 7 passing below the pivot shaft 10, and are secured to one surface of the clamping piece 9 by an adhesive agent, for example.

The elastic thin piece 30 is composed of an elastic thin sheet-like material such as a polyester sheet or a carbon fiber sheet of a thickness approximately 0.5 to 0.05 mm. On adhering this elastic thin sheet 30 to the clamping piece 9 and the inclined surface 4*b* of the stencil-mounting base 4, the clamping piece 9 is magnetically attracted to the magnetic plate 6, and the fastened end of the stencil S is sandwiched between the magnetic plate 6 and the clamping piece 9 to be secured to the outer peripheral surface of the printing drum 1, without loosening.

Figure 8:
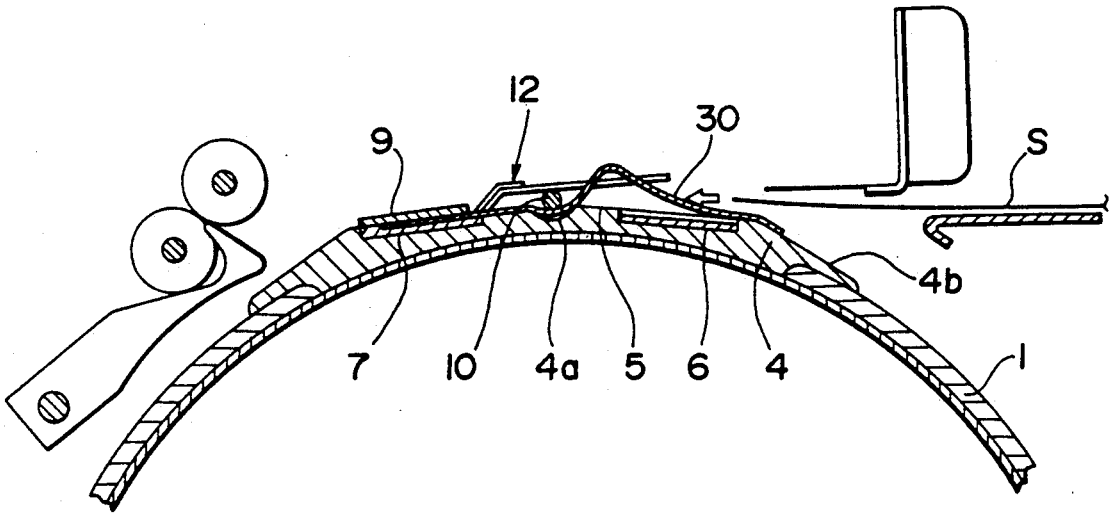
FIGS. 8 through 11 are cross-sectional views showing the operation of the apparatus of FIG. 7.
Figure 9:
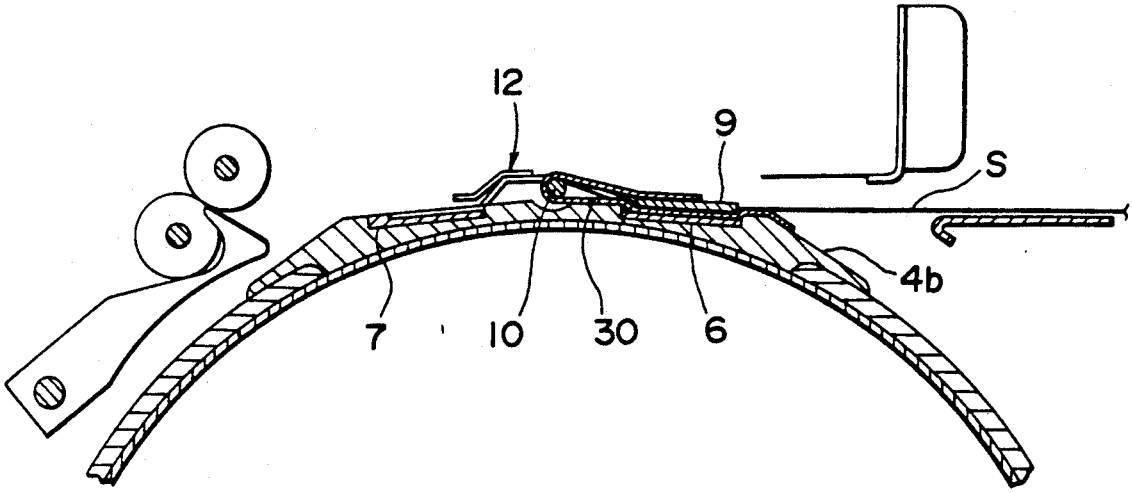

As the clamping piece 9 is pivoted from this clamping position to the non-clamping position, the part of the elastic thin piece wound around the pivot shaft 10 will be pushed out to the magnetic plate 6 side, and gradually comes floated in an arcuate shape until it assumes its state shown in FIG. 8. Further, on the upper surface 5 of the stencil-mounting base 4, a plurality of grooves are formed. Each elastic thin piece 30 fits to a respective one of the grooves so that the clamping piece 9 can be closely attracted to the magnetic plates 6, 7.

In operation, as shown in FIG. 8, the clamping piece 9 is set at the non-clamping state, and the stencil S is supplied to the printing drum 1 at the stencil-mounting position. The stencil S then enters the space between the holding members held at a predetermined level and the elastic thin piece 30 floating upwardly.

Thereafter, the clamping piece 9 is attracted to the magnetic plate 6. At this time, the stencil S seems to have been fastened between the clamping piece 9 and the magnetic plate 6 by the holding means 12 and the elastic thin piece 30.

Figure 10:
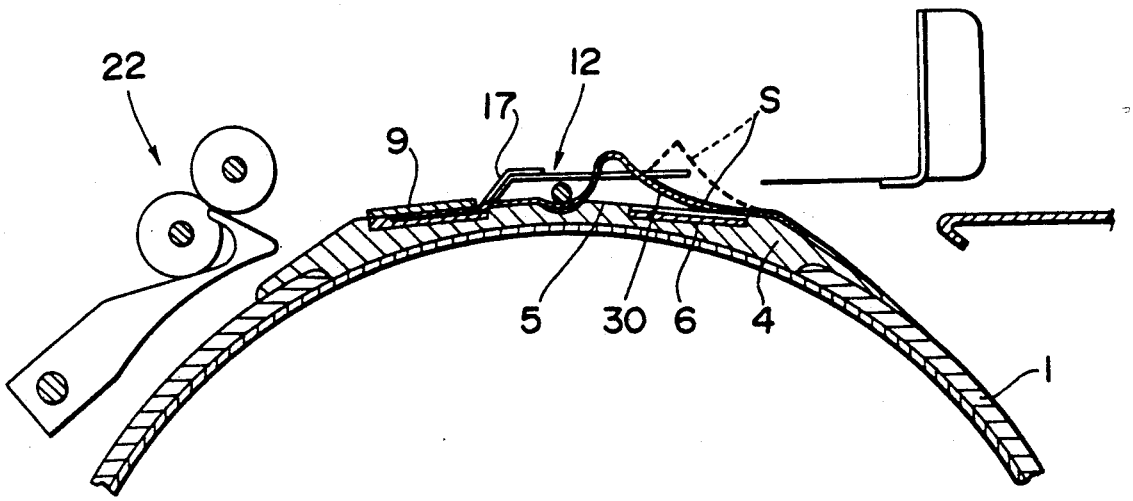

Upon completion of the cutting process, the winding process and the printing process, the removing of the stencil starts. As shown in FIG. 10, when the clamping piece 9 is pivoted to the non-clamping position, the elastic thin piece 30 is loosened and becomes floating over the magnetic plate 6. Simultaneously, the holding member 12 is immediately returned to the original position over the printing drum 1, as the clamping piece 9 presses downwardly the lower portion of the return plate 7.

As a result, the end of the stencil S even having been adhered to the upper part 5 of the stencil-mounting base 4, can be peeled from the drum 1 by the elastic thin piece 30. In addition, even if the curling state at the end of the stencil S would be promoted by any conditions, the curling is restrained by the holding means 12 after the clamping piece is released, like the first embodiment.

Figure 11:
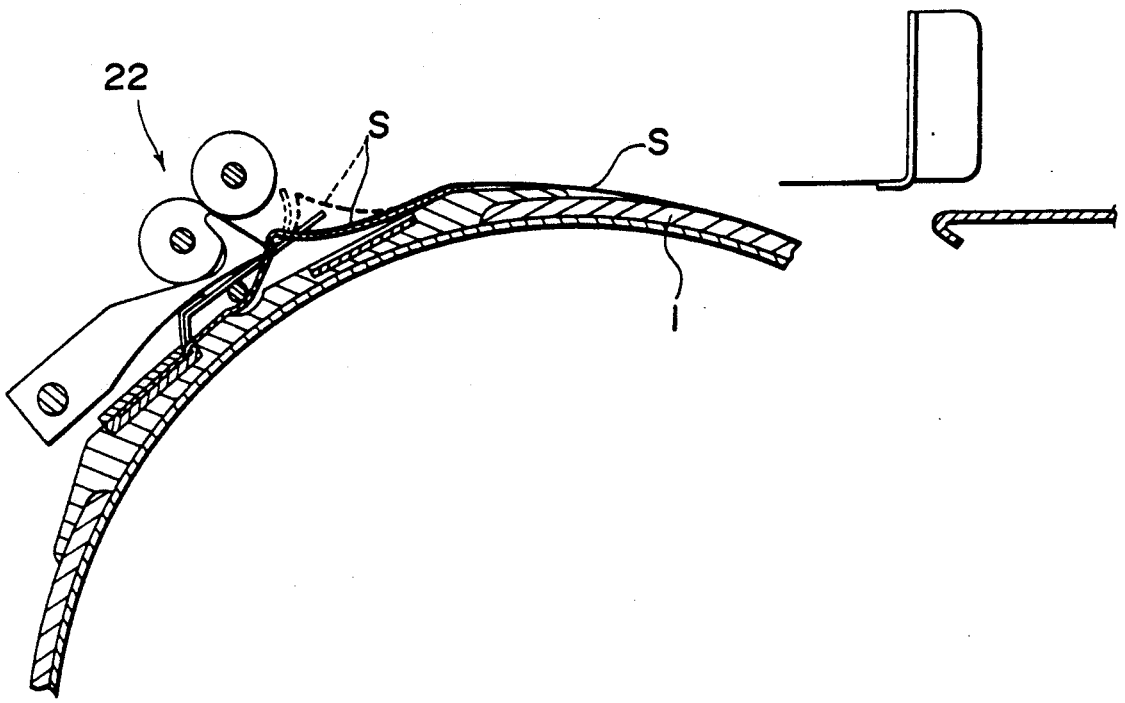

Thereafter, as shown in FIG. 11, the end of the stencil S held at a predetermined level will be introduced into the removing means 22 so that the stencil S is removed from the printing drum 1 due to its rotation.

Although the holding member 12 is composed of the elastic sheet 13 and the return plate 17 in the foregoing embodiments, it is also possible to form a stair-shaped member identical to the elastic sheet 13 with a desirably elastic material like a metallic plate and use this as a holding member.

According to this invention, the end of a stencil externally curling as releasing the clamping piece is held by the holding member so that the stencil can be reliably transported to the removing means and a normal removing process can be realized.

What is claimed is:

1. A mimeographic printing apparatus comprising:

(a) a printing drum rotatable with a processed stencil wound around the outer surface thereof;

(b) a clamping piece secured to said printing drum and pivotable between a clamping position to fasten one end of the stencil on said printing drum and a non-clamping position to release the fastened end of the stencil;

(c) a removing means for removing the released stencil from the printing drum; and (d) an elastic holding means disposed above the clamping position with a space from the printing drum enough to receive one end of the supplied stencil, said elastic holding means being engageable by said clamping piece to fasten one end of the stencil when said clamping piece is set at the clamping position, and returning to its position disposed above the clamping position when the clamping piece is pivoted from the clamping position.

2. A mimeographic printing apparatus comprising:

(a) a printing drum rotatable with a processed stencil wound around the outer surface thereof;

(b) a clamping piece secured to said printing drum and pivotable between a clamping position on said printing drum to fasten one end of the stencil on said printing drum and a non-clamping position on said printing drum to release the fastened end of the stencil;

(c) a removing means for removing the released stencil from the printing drum;

(d) an elastic sheet having a fixing portion fixed to the non-clamping position on said printing drum and a holding portion extending from the fixing portion over the clamping position on said printing drum with a space large enough to receive one end of a supplied stencil therebetween, said holding portion being pressed by said clamping piece to fasten one end of said stencil when said clamping piece is set at the clamping position;

(e) a rigid return plate having one end fixed to the holding portion of said elastic sheet at the fixing portion side and the other end free and extending to the fixing portion along said elastic sheet, said return plate functioning to return the holding portion of said elastic sheet to the position over the clamping position of said printing drum by being pressed down at its other end by said clamping piece when the clamping piece is set at the non-clamping position.

3. A mimeographic printing apparatus according to claim 2, further including a stencil-mounting base secured to said printing drum and on which said clamping piece is pivoted, said stencil-mounting base having a recess, formed at the clamping position and into which the holding portion of said elastic sheet fits.

4. A mimeographic printing apparatus comprising:

(a) a printing drum rotatable with a processed stencil wound around the outer surface thereof;

(b) a stencil-mounting base secured to the outer surface of said printing drum;

(c) a pivot shaft disposed on the upper surface of said stencil-mounting base with a predetermined space therebetween;

(d) a clamping piece supported by said pivot shaft and pivotable between a clamping position to fasten one end of the stencil on the upper surface of said stencil-mounting base and a non-clamping position to release the fastened end of the stencil;

(e) a removing means for removing the released stencil from the printing drum;

(f) an elastic holding means disposed above the clamping position with a space from the printing drum enough to receive one end of the supplied stencil, said elastic holding means fastening one end of the stencil on the upper surface of said stencil-mounting base by being pressed by said clamping piece when the clamping piece is set at the clamping position, and returning to its position disposed above the clamping position when the clamping piece is pivoted from the clamping position;

(g) an elastic thin piece having one end fixed to said stencil-mounting base near the clamping position, and the other end extending toward the non-clamping position through the space between the upper surface of said stencil-mounting base and said pivot shaft and fixed to said clamping piece, said elastic thin piece being wound around said pivot shaft at an intermediate portion and the one end being located on said stencil-mounting base by said clamping piece when said clamping piece is set at the clamping position, and the intermediate portion floats over the clamping position to raise one end of the stencil when said clamping piece is set at the non-clamping position.

* * * * *